US007198381B2

(12) United States Patent
Liang

(10) Patent No.: US 7,198,381 B2
(45) Date of Patent: Apr. 3, 2007

(54) LIGHT-EMITTING MODULE FOR AN OPTICAL SIGHT

(75) Inventor: Shang-Yung Liang, Tan-Tzu Hsiang (TW)

(73) Assignee: Asia Optical Co., Inc., Taichung (TW)

( * ) Notice: Subject to any disclaimer, the term of this patent is extended or adjusted under 35 U.S.C. 154(b) by 0 days.

(21) Appl. No.: 11/271,546

(22) Filed: Nov. 10, 2005

(65) Prior Publication Data

US 2006/0164847 A1 Jul. 27, 2006

(30) Foreign Application Priority Data

Jan. 27, 2005 (TW) ..... 94102501 A

(51) Int. Cl.
*F21V 21/14* (2006.01)

(52) U.S. Cl. ..... 362/110; 362/419; 362/372

(58) Field of Classification Search ..... 362/110, 362/111, 112, 269, 368, 372, 427, 419; 42/113–117
See application file for complete search history.

(56) References Cited

U.S. PATENT DOCUMENTS 1,452,651 A * 4/1923 Norrlin ..... 362/110

* cited by examiner

*Primary Examiner*—Sandra O'Shea
*Assistant Examiner*—Sharon Payne
(74) *Attorney, Agent, or Firm*—Merchant & Gould P.C.

(57) ABSTRACT

A light-emitting module includes a base having a mounting surface and formed with a pair of screw holes. An emitter holder has a bottom surface facing the mounting surface of the base, and is formed with a pair of apertures substantially corresponding in position to the screw holes in the base, respectively. A fulcrum projects from one of the mounting surface of the base and the bottom surface of the emitter holder, and contacts the other one of the two. Two fasteners pass respectively through the apertures in the emitter holder, and engage respectively the screw holes in the base. A light-emitting unit is mounted to the emitter holder. An optical sight that includes the light-emitting module is also disclosed.

10 Claims, 10 Drawing Sheets

LIGHT-EMITTING MODULE FOR AN OPTICAL SIGHT

CROSS-REFERENCE TO RELATED APPLICATION

This application claims priority of Taiwanese Application No. 094102501, filed Jan. 27, 2005.

BACKGROUND OF THE INVENTION

1. Field of the Invention

The present invention relates to a light-emitting module and an optical sight including the light-emitting module, in which significant adjustments may be made to the light-emitting module in different directions and without requiring disassembling of the optical sight.

2. Description of the Related Art

Referring to FIGS. 1, 2, and 3, a conventional optical sight includes a housing 10, an objective lens unit 11, an ocular lens unit 12, and a light-emitting module. The objective lens unit 11 is mounted to one end of the housing 10, whereas the ocular lens unit 12 is mounted to an opposite end of the housing 10. The housing 10, the objective lens unit 11, and the ocular lens unit 12 share a common central axis (C). The light-emitting module is mounted in the housing 10, and includes a casing 13, an emitter holder 14, two adjusting screws 15, a guide tube 16, a fixing screw 17, and a light emitter 18.

The casing 13 of the light-emitting module is formed with a pair of screw holes 131 that are separated by a predetermined distance along a first direction (X) which is perpendicular to the central axis (C), and is further formed with a first passage 132 positioned between the screw holes 131. The screw holes 131 and the first passage 132 extend through the casing 13 along a second direction (Z), which is parallel to the central axis (C). However, each of the screw holes 131 is separated from the central axis (C) by a predetermined distance.

The emitter holder 14 includes a frame section 141, a pair of flanges 143 extending from opposite sides of the frame section 141 along the first direction (X), and a second passage 142. The flanges 143 define elongated apertures 144, each of which opens outwardly from the frame section 141. The second passage 142 is substantially aligned with the first passage 132 of the casing 13.

The adjusting screws 15 are positioned respectively within the apertures 144 of the emitter holder 14, and engage respectively the screw holes 131 of the casing 13 to thereby secure the emitter holder 14 to the casing 13.

The guide tube 16 is mounted in the second passage 142 of the emitter holder 14.

The fixing screw 17 engages a radial screw hole (not visible) that is formed in the frame section 141 of the emitter holder 14, and that is in spatial communication with the second passage 142 of the emitter holder 14. By tightening the fixing screw 17, the position of the guide tube 16 within the second passage 142 of the emitter holder 14 may be secured.

The light emitter 18 is mounted in the guide tube 16, and is operable to project a light beam toward the objective lens unit 11. The beam of light projected from the light emitter 18 has an optical axis (L).

During manufacture of the optical sight, the guide tube 16 may be adjusted along the second direction (Z) to adjust a focal length of the light beam, that is, a distance of the light beam along the optical axis (L) from the light emitter 18, through the objective lens unit 11, and to a focal point. Further, by loosening the adjusting screws 15, the emitter holder 14 may be repositioned along the first direction (X), as well as along a third direction (Y), which is perpendicular to both the first and second directions (X,Z), thereby allowing for adjustment in the directionality of the optical axis (L). Following such adjustment, the light-emitting module is mounted in the housing 10, and the objective lens unit 11 and the ocular lens unit 12 are then mounted to opposite ends of the housing 10 as described above.

The conventional optical sight and light-emitting module have the following drawbacks:

1. Since the gaps between the adjusting screws 15 and the apertures 144 of the emitter holder 14 are relatively small, it is not possible to make any substantial adjustment of the light-emitting module along the third direction (Y).

2. True testing of the light beam projected by the light emitter 18 can be undertaken only after full assembly of the optical sight. As a result, if it is determined that further adjustment in the optical axis (L) and/or the focal length of the light beam projected from the light emitter 18 is required, the optical sight must be disassembled to allow for such adjustment. This is a time-consuming and labor-intensive process, particularly if multiple readjustments are necessary.

SUMMARY OF THE INVENTION

The object of the present invention is to provide a light-emitting module that may be adjusted by a significant amount in various directions.

Another object of the present invention is to provide an optical sight having the light-emitting module mounted therein, in which the light-emitting module may be adjusted without requiring disassembling of the optical sight.

The light-emitting module of this invention comprises: a base having a mounting surface and formed with a pair of screw holes that are separated by a predetermined distance; an emitter holder having a bottom surface facing the mounting surface of the base, the emitter holder being formed with a pair of apertures substantially corresponding in position to the screw holes in the base, respectively; a fulcrum projecting from one of the mounting surface of the base and the bottom surface of the emitter holder, and contacting the other one of the mounting surface of the base and the bottom surface of the emitter holder; a pair of fasteners that pass respectively through the apertures in the emitter holder and that engage respectively the screw holes in the base; and a light-emitting unit mounted to the emitter holder.

The optical sight of this invention comprises: a housing having opposite ends; an objective lens unit mounted to one of the ends of the housing; an ocular lens unit mounted to the other of the ends of the housing; and the light-emitting module mounted in the housing.

In a preferred embodiment, the housing is formed with an access hole, and the light-emitting module is mounted in the housing at a position corresponding to the access hole, such that the light-emitting module is accessible via the access hole in the housing.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
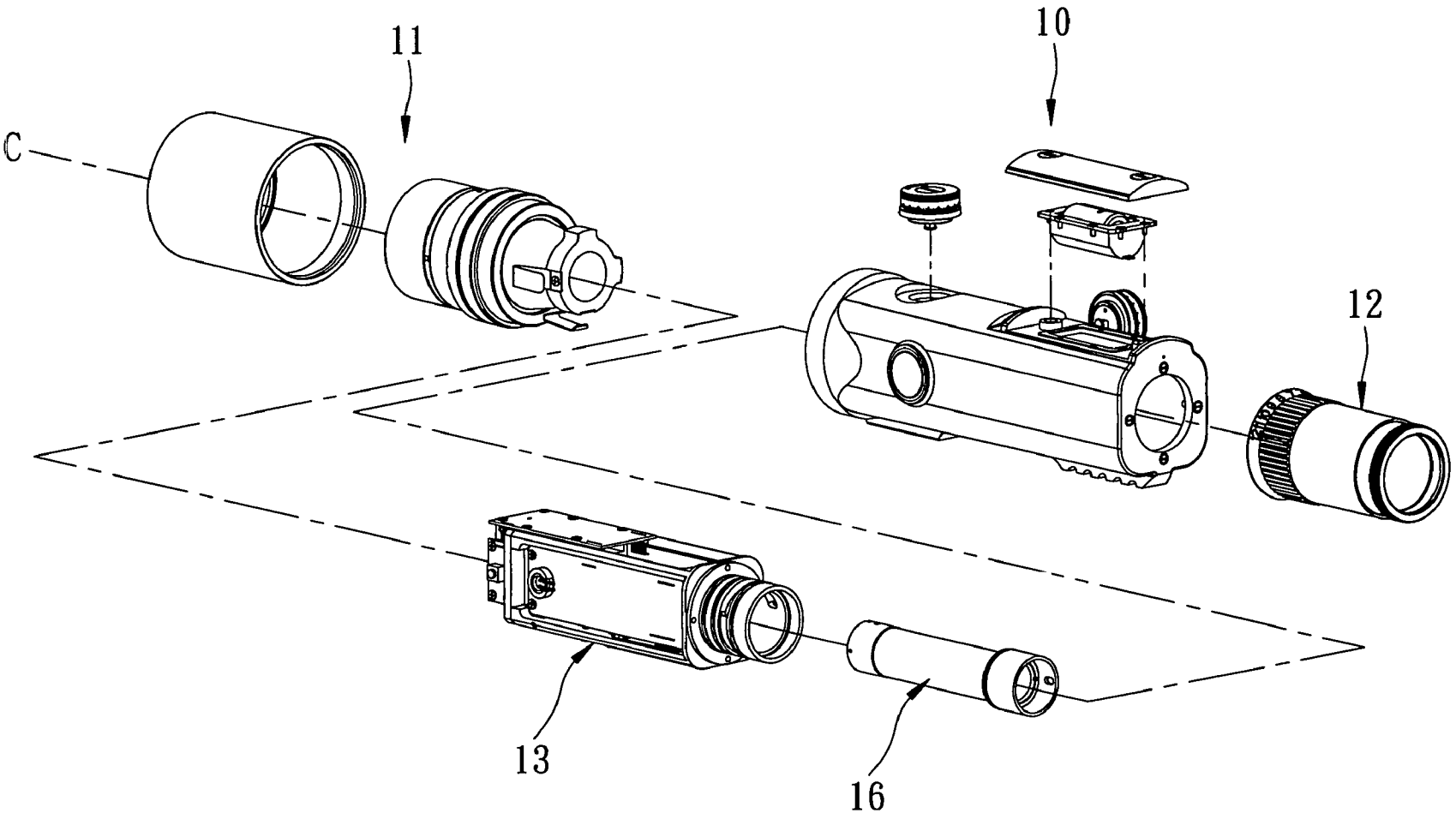
FIG. 1 PRIOR ART
FIG. 1 is an exploded perspective view of a conventional optical sight having a light-emitting module.
Figure 2:
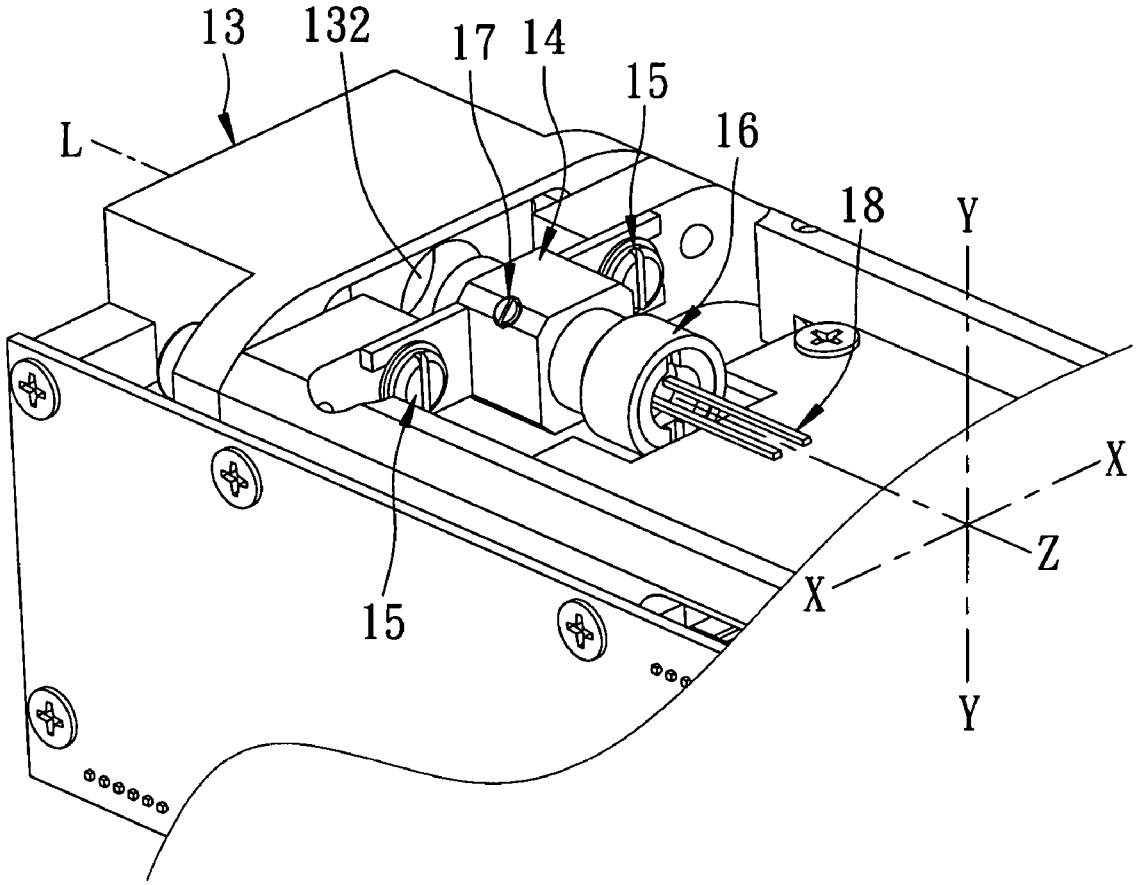
FIG. 2 PRIOR ART
FIG. 2 is a fragmentary assembled perspective view of the light-emitting module of the optical sight shown in FIG. 1.
Figure 3:
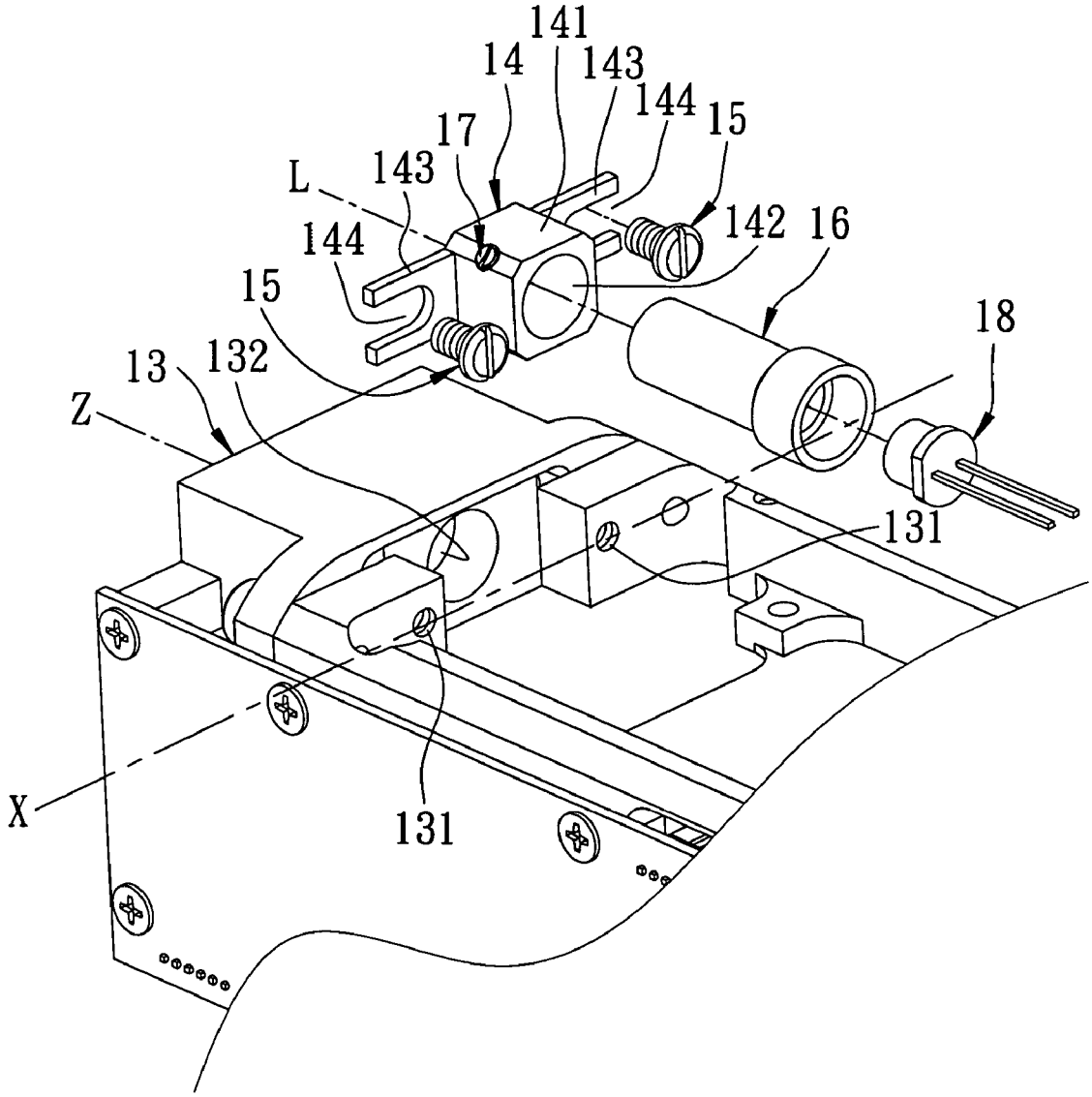
FIG. 3 PRIOR ART
FIG. 3 is a fragmentary exploded perspective view of the light-emitting module of the optical sight shown in FIG. 1.
Figure 4:
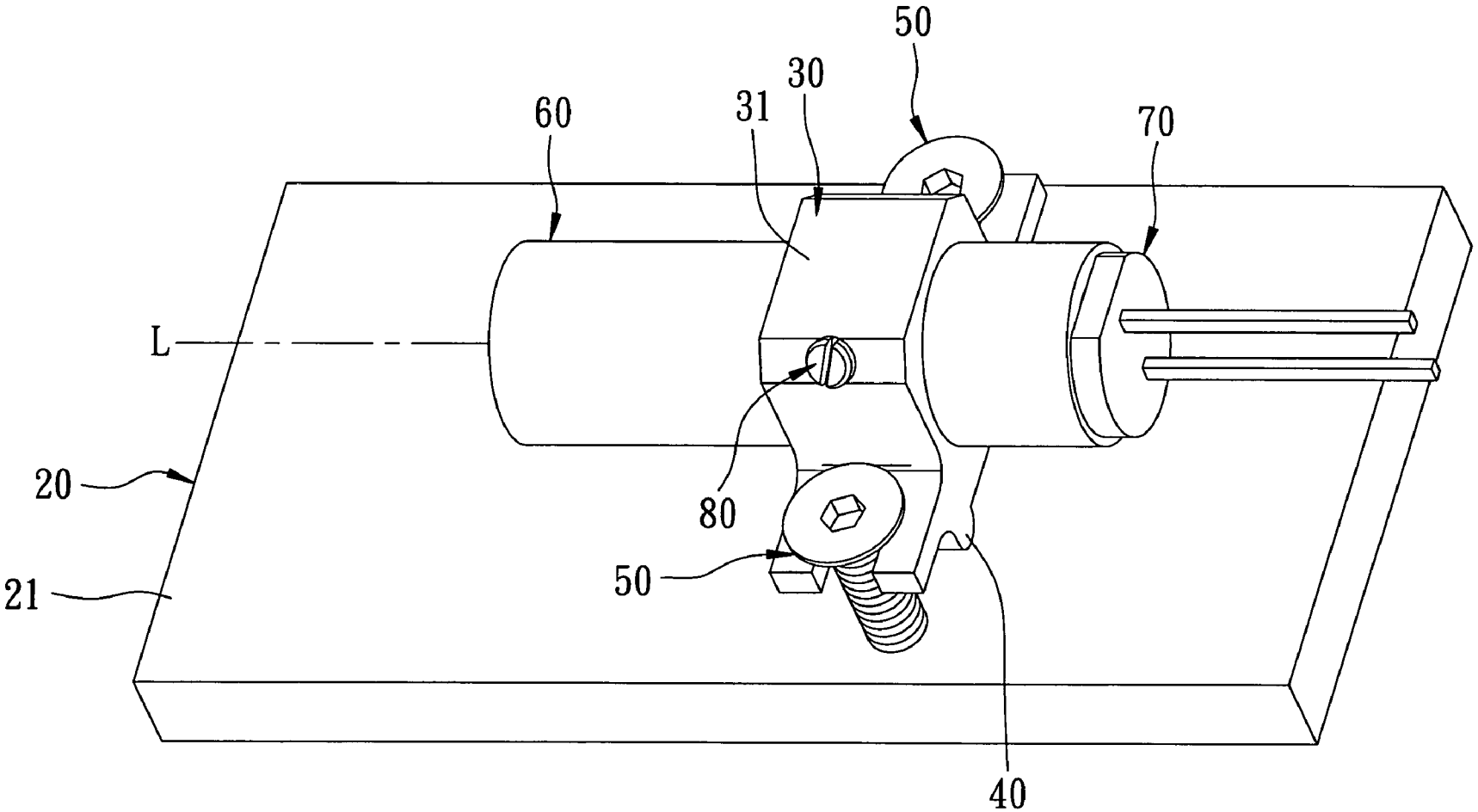
FIG. 4 is a perspective view of a light-emitting module according to a preferred embodiment of the present invention.
Figure 5:
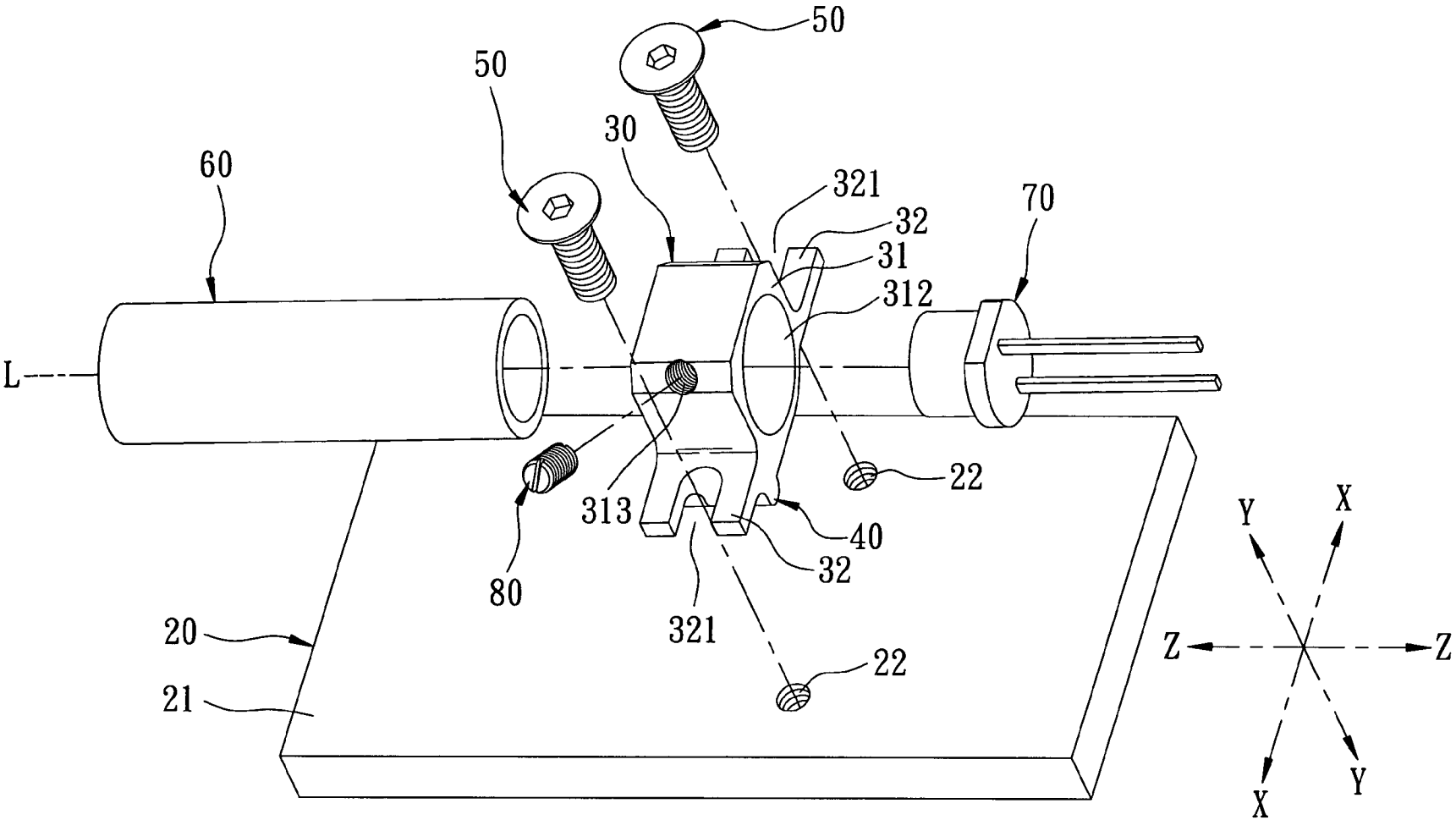
FIG. 5 is an exploded perspective view of the light-emitting module of FIG. 4.
Figure 6:
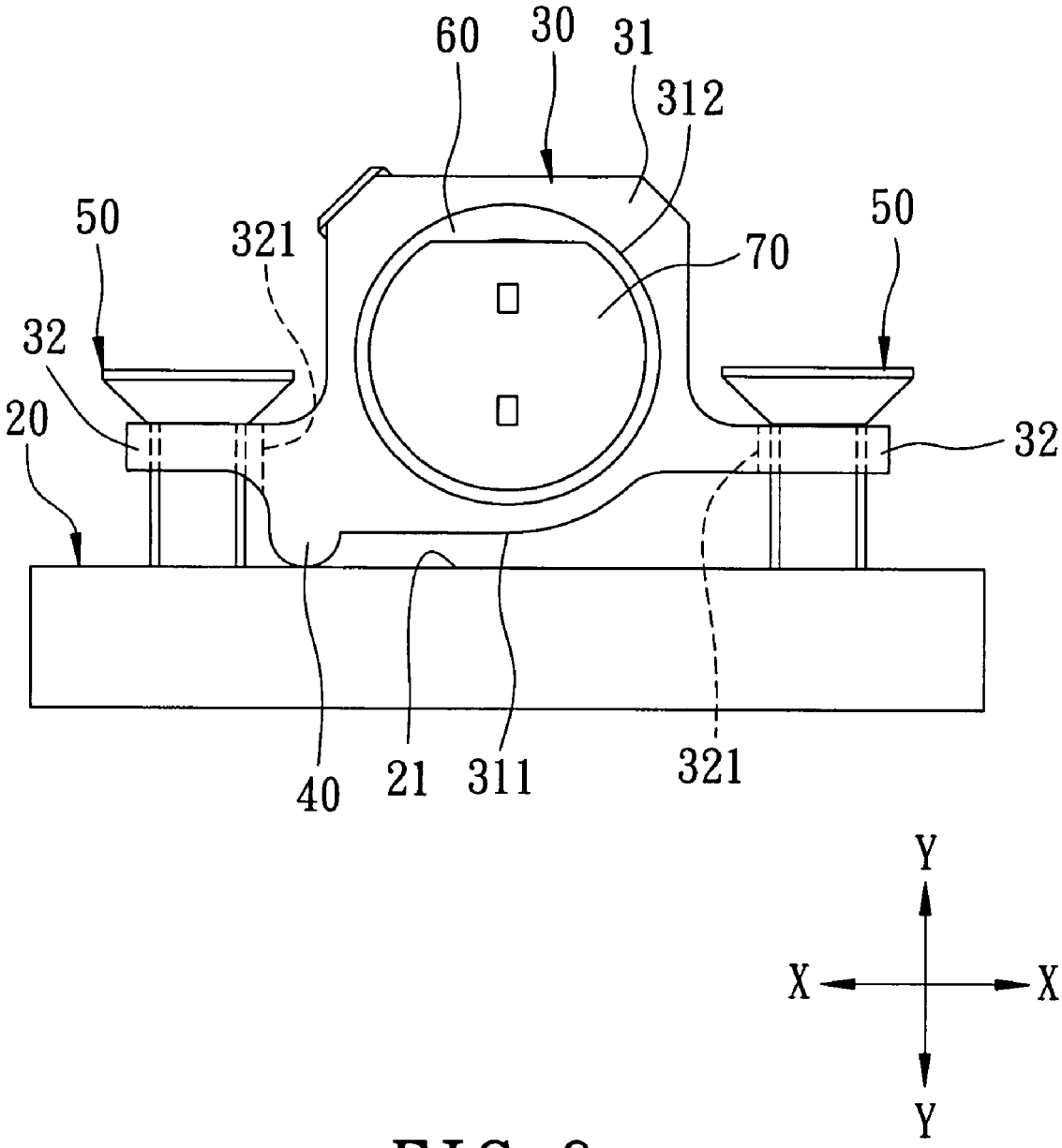
FIG. 6 is a schematic rear view of the light-emitting module of FIG. 4.

Referring to FIGS. 4, 5, and 6, a light-emitting module for an optical sight according to a preferred embodiment of the present invention includes a base 20, an emitter holder 30, a fulcrum 40, a pair of first fasteners 50, and a light-emitting unit.

The base 20 has a mounting surface 21, and is formed with a pair of first screw holes 22 that are separated by a predetermined distance along a first direction (X).

The emitter holder 30 includes a frame section 31, and a pair of flanges 32. The frame section 31 has a bottom surface 311 facing the mounting surface 21 of the base 20, and is formed with a passage hole 312 that extends along a second direction (Z), which is perpendicular to the first direction (X). The frame section 31 is further formed with a radial second screw hole 313 that is in spatial communication with the passage hole 312. The flanges 32 extend from opposite sides of the frame section 31 along the first direction (X). Each of the flanges 32 defines an elongated aperture 321 that opens outwardly from the frame section 31. The apertures 321 substantially correspond in position to the first screw holes 22 in the base 20, respectively.

The fulcrum 40 projects integrally from the bottom surface 311 of the emitter holder 30, and a distal end of the fulcrum 40 contacts the mounting surface 21 of the base 20. Further, the fulcrum 40 is off-centered with respect to a geometric center of the emitter holder 30. In the preferred embodiment, the fulcrum 40 is formed in closer proximity to one of the flanges 32 than to the other one of the flanges 32. Alternatively, the fulcrum 40 may be integrally formed on the mounting surface 21 to project upwardly toward the emitter holder 30 for contacting the bottom surface 311.

The first fasteners 50 pass respectively through the apertures 321 in the flanges 32, and engage respectively the first screw holes 22 in the base 20 to thereby secure the emitter holder 30 to the base 20. When engaging the first screw holes 22, the first fasteners 50 are extended along a third direction (Y), which is perpendicular to the first and second directions (X,Z).

The light-emitting unit is mounted to the emitter holder 30, and includes a guide tube 60, a light emitter 70, and a second fastener 80. The guide tube 60 is inserted into the passage hole 312 in the frame section 31 of the emitter holder 30 to thereby extend along the second direction (Z). The light emitter 70 is mounted in one end of the guide tube 60, and is operable to project a light beam having an optical axis (L) that extends substantially along the second direction (Z). The second fastener 80 engages the second screw hole 313 of the emitter holder 30, and may be tightened to thereby fix the position of the guide tube 60 within the passage hole 312.

Repositioning of the guide tube 60 within the passage hole 312 allows for adjustment in a focal length of the light beam, that is, a distance of the light beam along the optical axis (L) from the light emitter 70 to a focal point. Further, the emitter holder 30 may be repositioned along the first direction (X) by loosening the first fasteners 50 and manually manipulating the emitter holder 30, after which the first fasteners 50 are re-tightened. In addition, by independently adjusting the tightening degree of the first fasteners 50 respectively in the first screw holes 22 of the base 20, the emitter holder 30 may be pivoted about the fulcrum 40 such that the optical axis (L) of the light emitter 70 is repositioned along the third direction (Y), or more precisely, repositioned diagonally between the first and third directions (X,Y).

Figure 7:
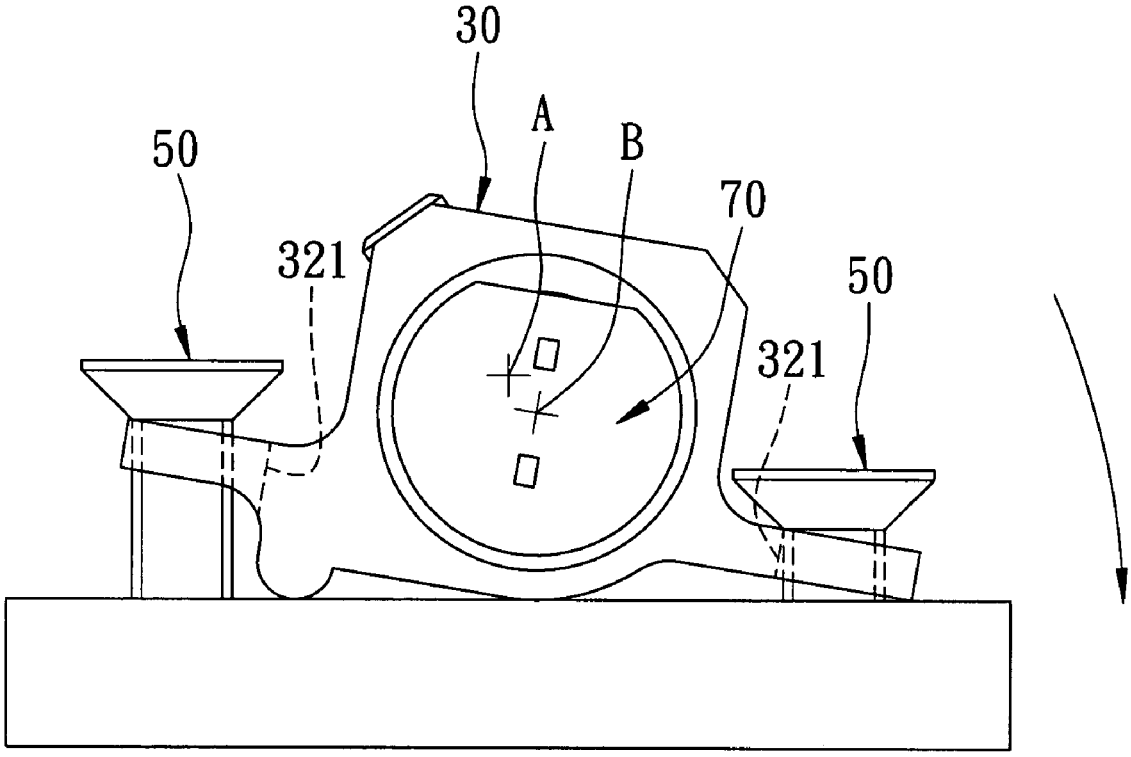
FIG. 7 is a view similar to FIG. 6, but depicting an example of an adjusted state of the light-emitting module.
Figure 7:
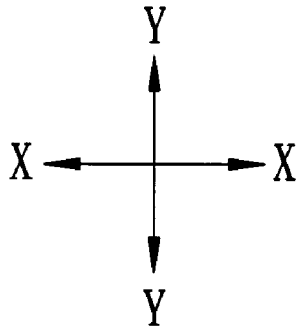

Referring to FIGS. 4 and 7, if the optical axis (L) of the light emitter 70 is located at an initial point (A), it is offset upwardly and leftwardly from point (B), which is assumed for illustrative purposes to be the ideal location. To correct the positioning of the optical axis (L), the first fasteners 50 are first loosened by a suitable amount, and the emitter holder 30 is then repositioned rightwardly along the first direction (X). Next, the left first fastener 50 is tightened slightly from its loosened state, while the right first fastener 50 is tightened by an amount sufficient to complete correction. As a result, the optical axis (L) adjusted to point (B).

Figure 8:
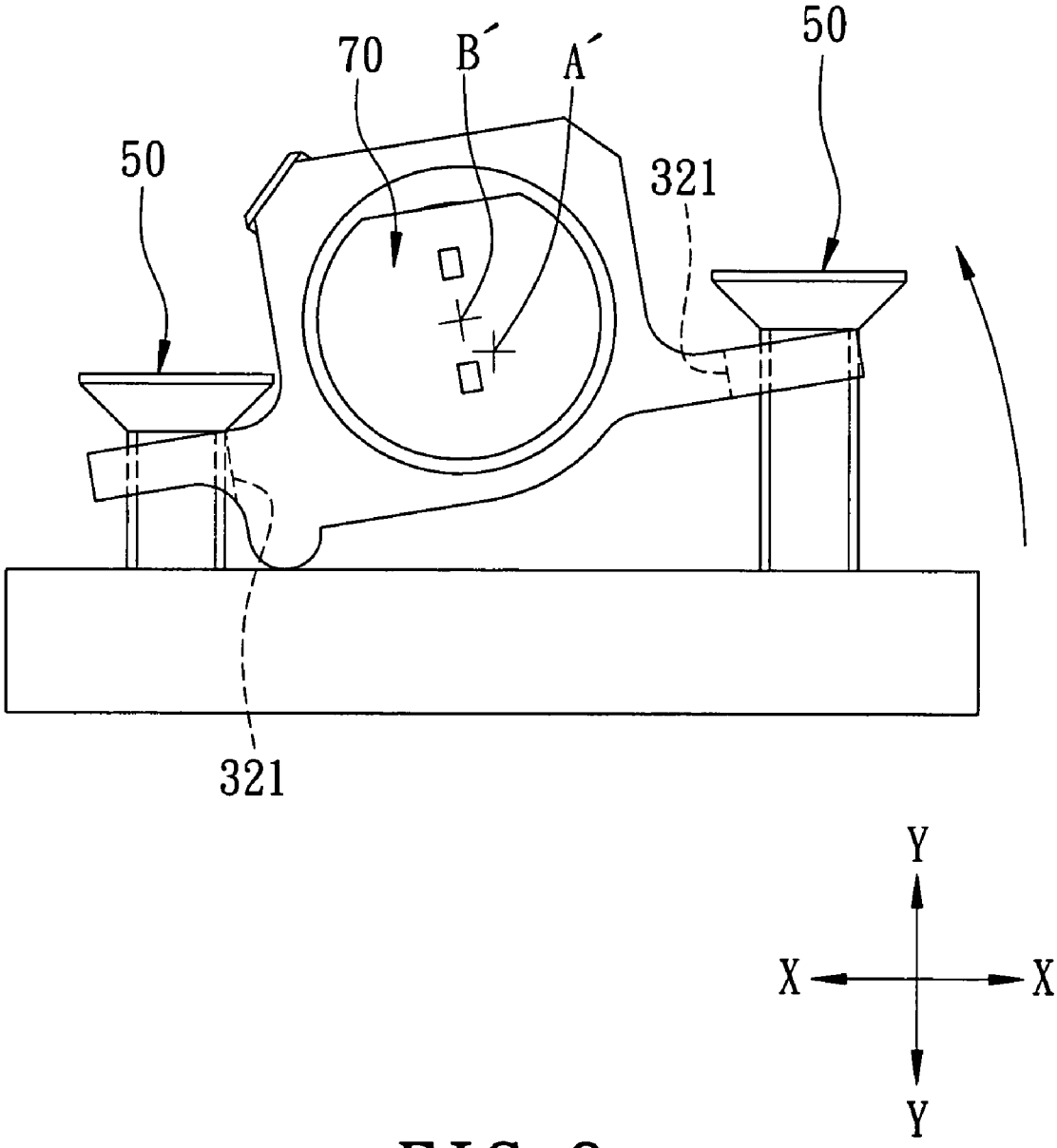
FIG. 8 is a view similar to FIG. 6, but depicting another example of an adjusted state of the light-emitting module.

Similarly, referring to FIGS. 4 and 8, if the optical axis (L) of the light emitter 70 is located at initial point (A'), it is offset downwardly and rightwardly from ideal point (B'). To perform position correction, the first fasteners 50 are first loosened by a suitable amount, and the emitter holder 30 is then repositioned leftwardly along the first direction (X). Next, the left first fastener 50 is tightened slightly from its loosened state, while the right first fastener 50 is loosened by an amount sufficient to complete correction. As a result, the optical axis (L) is adjusted to point (B').

Through the presence of the fulcrum 40, adjustment of the emitter holder 30 maybe performed by a significant amount along the third direction (Y).

Figure 9:
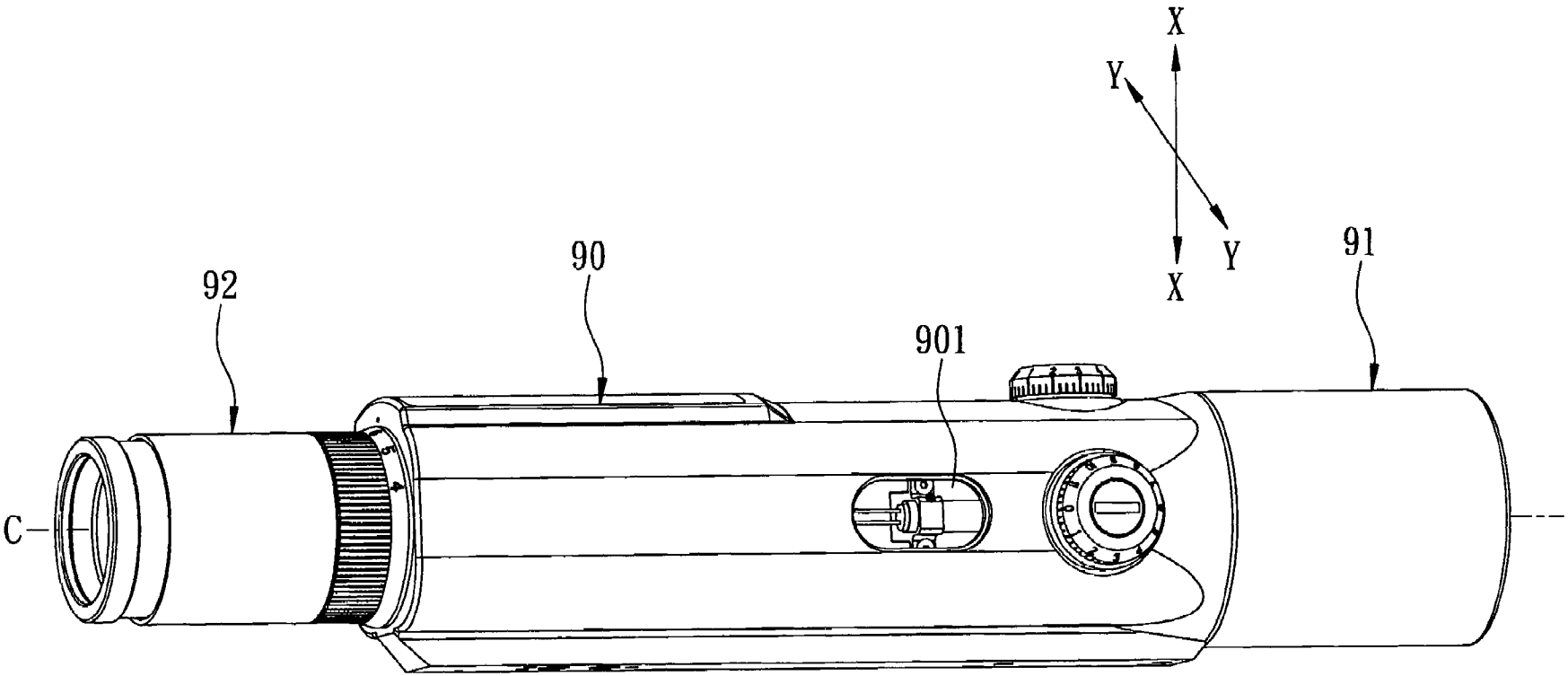
FIG. 9 is a perspective view of the preferred embodiment of an optical sight employing the light-emitting module according to the present invention.
Figure 10:
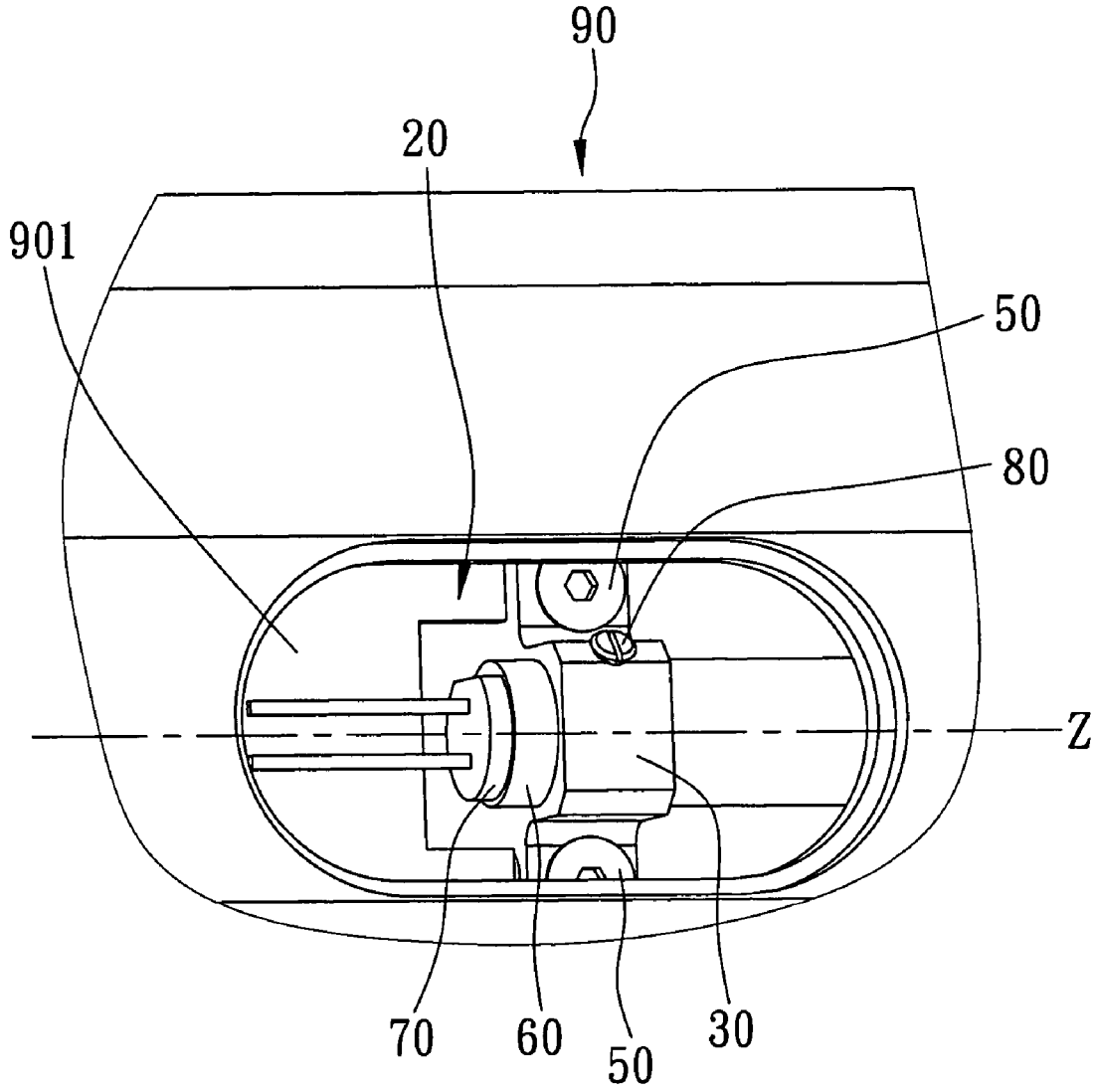
FIG. 10 is a fragmentary perspective view of the optical sight of FIG. 9, illustrating the mounting of the light-emitting module in the optical sight.

With additional reference to FIGS. 9 and 10, the preferred embodiment of an optical sight employing the above-described light-emitting module will now be described. The optical sight includes a housing 90, an objective lens unit 91, an ocular lens unit 92, and the light-emitting module.

The housing 90 has opposite ends, and is formed with an access hole 901. The objective lens unit 91 is mounted to one of the ends of the housing 90, and the ocular lens unit 92 is mounted to the other of the ends of the housing 90.

The light-emitting module is mounted in the housing 90 at a position corresponding to the access hole 901 in the housing 90, such that the light-emitting module is accessible via the access hole 901. The optical axis (L) of the light emitter 70 of the light-emitting module is substantially parallel to a center axis (C) shared by the housing 90, the objective lens unit 91, and the ocular lens unit 92.

With the configuration described above, following full assembly of the optical sight, adjustment to the light-emitting module may be made via the access hole 901. For example, a tool such as a screwdriver may be passed through the access hole 901 to thereby loosen and tighten the first fasteners 50, and perform adjustment of the emitter holder 30 along the first and third directions (X,Y) as described above. Furthermore, the guide tube 60 may also be repositioned along the second direction (Z) to adjust the focal length of the light beam projected from the light emitter 70 as described above.

Hence, the light-emitting module maybe adjusted even after the optical sight is fully assembled without requiring disassembling of the optical sight. This provides for improved manufacturing productivity, and allows the end user to perform adjustments him or herself without seeking after-service help.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A light-emitting module, comprising:

a base having a mounting surface and formed with a pair of first screw holes that are separated by a predetermined distance along a first direction;

an emitter holder having a bottom surface facing said mounting surface of said base, said emitter holder being formed with a pair of apertures substantially corresponding in position to said first screw holes in said base, respectively;

a fulcrum projecting from one of said mounting surface of said base and said bottom surface of said emitter holder, and contacting the other one of said mounting surface of said base and said bottom surface of said emitter holder;

a pair of first fasteners that pass respectively through said apertures in said emitter holder and that engage respectively said first screw holes in said base; and a light-emitting unit mounted to said emitter holder.

2. The light-emitting module of claim 1, wherein said fulcrum projects from said bottom surface of said emitter holder.

3. The light-emitting module of claim 2, wherein said fulcrum is off-centered with respect to a geometric center of said emitter holder.

4. The light-emitting module of claim 1, wherein said emitter holder includes a frame section formed with a passage hole that extends along a second direction, which is perpendicular to the first direction, and further formed with a radial second screw hole that is in spatial communication with said passage hole;

said light-emitting unit including a guide tube inserted into said passage hole in said frame section, a light emitter mounted in one end of said guide tube, and a second fastener engaging said second screw hole in said frame section to secure said guide tube in said passage hole.

5. The light-emitting module of claim 4, wherein said emitter holder further includes a pair of flanges extending from opposite sides of said frame section along the first direction, said apertures being formed respectively in said flanges, said fulcrum being formed in closer proximity to one of said flanges than to the other one of said flanges.

6. An optical sight, comprising:

a housing having opposite ends, said housing being formed with an access hole;

an objective lens unit mounted to one of said ends of said housing;

an ocular lens unit mounted to the other of said ends of said housing; and a light-emitting module mounted in said housing and including a base having a mounting surface and formed with a pair of first screw holes that are separated by a predetermined distance along a first direction, an emitter holder having a bottom surface facing said mounting surface of said base, said emitter holder being formed with a pair of apertures substantially corresponding in position to said first screw holes in said base, respectively, a fulcrum projecting from one of said mounting surface of said base and said bottom surface of said emitter holder, and contacting the other one of said mounting surface of said base and said bottom surface of said emitter holder, a pair of first fasteners that pass respectively through said apertures in said emitter holder and that engage respectively said first screw holes in said base, and a light-emitting unit mounted to said emitter holder;

said light-emitting module being mounted in said housing at a position corresponding to said access hole, such that said light-emitting module is accessible via said access hole in said housing.

7. The optical sight of claim 6, wherein said fulcrum projects from said bottom surface of said emitter holder.

8. The optical sight of claim 7, wherein said fulcrum is off-centered with respect to a geometric center of said emitter holder.

9. The optical sight of claim 6, wherein said emitter holder includes a frame section formed with a passage hole that extends along a second direction, which is perpendicular to the first direction, and further formed with a radial second screw hole that is in spatial communication with said passage hole;

said light-emitting unit including a guide tube inserted into said passage hole in said frame section, a light emitter mounted in one end of said guide tube, and a second fastener engaging said second screw hole in said frame section to secure said guide tube in said passage hole.

10. The optical sight of claim 9, wherein said emitter holder further includes a pair of flanges extending from opposite sides of said frame section along the first direction, said apertures being formed respectively in said flanges, said fulcrum being formed in closer proximity to one of said flanges than to the other one of said flanges.

* * * * *